US005411078A

United States Patent [19]

Ares

[11] Patent Number: 5,411,078

[45] Date of Patent: May 2, 1995

[54] AIR AND EVAPORATIVELY COOLED HEAT EXCHANGER AND REFRIGERATING SYSTEM THEREFOR

[76] Inventor: Roland Ares, 1004 Wedgewood Dr., St. Charles, Mo. 63303

[21] Appl. No.: 166,357

[22] Filed: Dec. 13, 1993

[51] Int. Cl.[6] ..... F22B 3/00

[52] U.S. Cl. ..... 165/113; 62/171; 62/181; 62/305

[58] Field of Search ..... 165/113, 112, 104.11; 62/305, 171, 181; 261/153

[56] References Cited

U.S. PATENT DOCUMENTS

| | | | |
|---|---|---|---|
| 2,166,397 | 7/1939 | Deverall | 62/305 |
| 3,775,993 | 12/1973 | Murphy | 62/305 |
| 3,913,345 | 10/1975 | Goettl | 62/171 |
| 4,290,274 | 9/1981 | Essex | 62/171 |
| 5,333,469 | 8/1994 | Hullar et al. | 62/181 |

FOREIGN PATENT DOCUMENTS

| | | | |
|---|---|---|---|
| 150789 | 9/1982 | Japan | 62/171 |
| 845844 | 8/1960 | United Kingdom | 62/305 |

*Primary Examiner*—A. Michael Chambers
*Attorney, Agent, or Firm*—Daniel E. Kramer

[57] ABSTRACT

A fluid cooler having contiguous air cooled and evaporative portions and having a heat exchanger common to both portions. The heat exchanger employs a series of straight tubes which traverse both the air-cooled and the evaporative portions. Separate fans are provided for the air-cooled and for the evaporative portions. The segments of the straight tube laying within the air-cooled portion are finned. The segments of straight tubes laying within the evaporative portion are partially finned and extend further downwards as a sub-cooling section of the evaporative coil portion, thereby providing means for cooling the fluid to a temperature lower than ambient dry-bulb temperature.

20 Claims, 3 Drawing Sheets

AIR AND EVAPORATIVELY COOLED HEAT EXCHANGER AND REFRIGERATING SYSTEM THEREFOR

BACKGROUND

1. Field of the Invention

The present invention relates to a heat transfer device for cooling a fluid, the device having an air-cooled portion and a contiguous evaporatively cooled portion and to a refrigerating package utilizing such a heat transfer device as a condenser and liquid refrigerant subcooler.

2. Physical Principles and Prior Art

Fluid coolers utilizing air alone as the coolant are well known. Such fluid coolers are known as air-cooled fluid coolers. Fluid coolers utilizing an air stream combined with evaporation of water on the heat transfer surface are also well known. Such fluid coolers are called evaporatively cooled fluid coolers. Evaporative coolers generally have a water reservoir or sump positioned directly beneath a sprayed coil or similar heat transfer surface through which the fluid to be cooled is passed. A pump draws water from the sump and circulates it over the coil through spray nozzles in excess of the evaporation rate while air is blown by fans over the wetted coil surfaces. The excess water falls off the wetted coil surfaces into the sump for recirculation. The evaporation of the water from the external coil surfaces cools the fluid flowing inside. A float in the sump senses the water level and controls the flow of make-up water to replace that lost by evaporation on the wetted coil surfaces. It is generally considered desirable to bleed off a small amount of water from the sump to the drain to prevent accumulation of excess concentrations of dissolved salts which could precipitate on the coil or in the sump causing operational problems.

Evaporation of water from the wetted surfaces of the coil provides a powerful cooling effect because the sink temperature is the wet bulb temperature of the ambient air.

The sink temperature of a coolant is the lowest temperature to which a substance can theoretically be cooled by heat transfer to that coolant. Dry bulb temperature of air is the temperature of air measured by an ordinary thermometer. Wet bulb temperature is the temperature of air measured by the same thermometer used in dry bulb measurements, except the bulb is enclosed within a porous wetted glove or sock. The flow of air over the wetted sock cools the bulb to a temperature lower than the dry bulb temperature by a number of degrees called the wet bulb depression. The wet bulb depression varies with the relative humidity. When the relative humidity is near 100 percent, as in tropical rain forests, the wet bulb depression is small. When the relative humidity is low, as in the desert, the wet bulb depression is large. There are published charts which show the wet bulb temperature and wet bulb depression for each air temperature and relative humidity. These charts are called psychrometric charts.

Since the sink temperature for evaporative coolers is the wet bulb temperature, such coolers have the capability of cooling fluids to lower temperatures, in some cases much lower, than air-cooled coolers.

When an evaporative cooler is used in a refrigeration system as condenser it is called an evaporative condenser. Evaporative condensers are typically much smaller than air-cooled condensers having the same capacity.

Systems having evaporative condensers are frequently employed in an air-cooled mode during cold weather. In the air-cooled mode the recirculated water supply is stopped and cold ambient air alone is circulated over the generally bare (unfinned) evaporative condenser tubes to provide the thermal sink for the heat required to be rejected at the condenser. Because evaporative condensers usually have relatively small heat transfer surfaces for their design heat load, the water circulation generally cannot be stopped until the air temperature is near freezing. This complicates the operation and can lead to freeze-up of the condenser.

It has been common practice to provide a separate subcooling coil submerged in the sump of the evaporative condenser. In many systems the subcooling coil is connected to receive the liquid flow from a liquid receiver. In other systems, especially those having limited refrigerant charge or floating receivers the sub-cooling coil is connected directly to the condenser outlet.

When air-cooled fluid coolers are employed in refrigerating systems as condensers they are known as air-cooled condensers. Though air-cooled condensers have the advantage of operating dry and thereby avoiding the corrosion associated with the use of water for cooling, they exhibit the important limiting disadvantage that the condensing temperature rises degree for degree with the ambient dry bulb temperature. During weather when air temperatures exceed 95° F. air-cooled condensing temperatures can exceed 125° F. This condensing temperature may be too high for system employing refrigerants which get very hot on compression, such as ammonia or HCFC-22 (monochloro difluoromethane). To cope with these high condensing temperatures, users of air-cooled condensing equipment have sometimes provided water sprays for supplementary cooling.

In one such arrangement water is sprayed into the entering airstreams of the air-cooled condenser to provide adiabatic cooling of the airstream before it enters the condenser. This arrangement does not allow water to evaporate directly on the condenser heat transfer surface. As a result the life of the condenser surface is generally not adversely affected.

In another arrangement water is sprayed directly onto the heat transfer surfaces of the air-cooled condenser. In this arrangement the life of the heat transfer surface can be reduced by deposition of minerals onto the tubes and fins of the condenser surface and by corrosion of the heat transfer surface.

Air-cooled condensers are also frequently provided with subcooling coils. These sub-cooling coils are frequently made integral with the condenser coil and are positioned to be subject to the relatively cool condenser inlet airstream. The subcooling coils in some system designs employ a "floating" liquid receiver. In a floating receiver design the sub-cooling coil is connected directly to the outlet of the condenser and the receiver is connected by a single pipe to the main liquid line connecting the sub-cooler outlet to the evaporator. In other designs a flow-through receiver is employed. In this design the receiver has an inlet and an outlet connection and is connected to receive the full flow of condensed liquid from the condenser outlet. The subcooling coil is connected in the liquid line connecting the receiver outlet with the evaporator.

As described above, the condensing temperature of air-cooled systems rises degree for degree with the outside ambient temperature. Conversely, as the ambient temperature falls, the condensing temperature also falls degree for degree with the ambient temperature. Though, thermodynamically, this would seem to be a totally desirable characteristic, paradoxically, many systems fail to refrigerate properly when the ambient becomes very cold and the condensing temperature and corresponding liquid pressure becomes very low. Pressure controls to establish minimum condensing temperatures or minimum liquid pressures have been provided to better enable these systems to operate year-round. These controls are frequently called "winter controls" because they allow the system to operate correctly during cold weather. Still other systems have been designed to operate without any winter controls. These systems have been designed to operate correctly, even at sharply reduced condensing temperatures and correspondingly low liquid pressures. In other words, their condensing temperatures have been allowed to float downwards as well as upwards. These systems are called "floating head pressure" systems. Systems with "floating" receivers, i.e. those receivers not directly in the flow stream, can be of either the winter controlled or the "floating head pressure" design.

Both air-cooled and evaporative coolers have been employed to cool recirculating liquid such as glycol/-water solutions for circulation through heat exchangers such as water-cooled condensers to provide cooling therefor.

OBJECTS AND ADVANTAGES

Accordingly, it is a primary object of the present invention to provide a heat transfer device which provides the advantages of both air-cooled and evaporative coolers and condensers in a single unit without exhibiting the major disadvantages of either. The several objects and advantages of the present invention are:

To provide a unitary heat transfer device capable of serving as a vapor condenser or as a cooler for a flow of liquid or vapor.

To provide such a heat transfer device capable of operating in high dry-bulb ambients and providing low sink temperatures and low condensing temperatures during such operating condition.

To provide such a heat transfer device embodying a dry air-cooled section combined with an integral evaporatively cooled section where the advantages of both can be secured and the disadvantages of both, avoided.

To provide such a heat transfer device where the combination provides unusual low ambient capabilities not attainable by simple air-cooled systems.

To provide an air-cooled refrigerant condenser having an integral evaporative condenser.

To provide such an air-cooled condenser have a reduced refrigerant charge inventory.

To provide a unitary refrigerating package including such an improved condenser design.

To provide such a unitary refrigerating package including an integral liquid chilling evaporator.

To provide such a unitary refrigerating package having a remote evaporator connected to the package.

Other objects and advantages will become apparent as the structure and operation of the present invention is further disclosed.

SUMMARY OF THE INVENTION

The present invention is a heat transfer device for transferring heat from a fluid to air. The device comprises a heat transfer element having a face area, the face area being divided into first and second portions. There is a first array of spaced apart substantially parallel tubes distributed over the face area. There are fins on the tubes within the first portion of the face area. There is a second array of spaced apart substantially parallel tubes positioned under the second portion of the face area. There is a divider between the first face area portion and the second face area portion. There are means for spraying water over the second face area portion. And there are provided means for moving air over the heat transfer element.

BRIEF DESCRIPTION OF THE DRAWINGS

The foregoing summary, as well as the following description of the preferred embodiments, will be better understood when read in conjunction with the appended drawings. For the purpose of illustrating the invention, there is shown in the drawings an embodiment which is presently preferred, it being understood, however, that the invention is not limited to the specific instrumentalities or the precise arrangement of elements disclosed.

DETAILED DESCRIPTION OF THE INVENTION

The Refrigeration System

Figure 1:
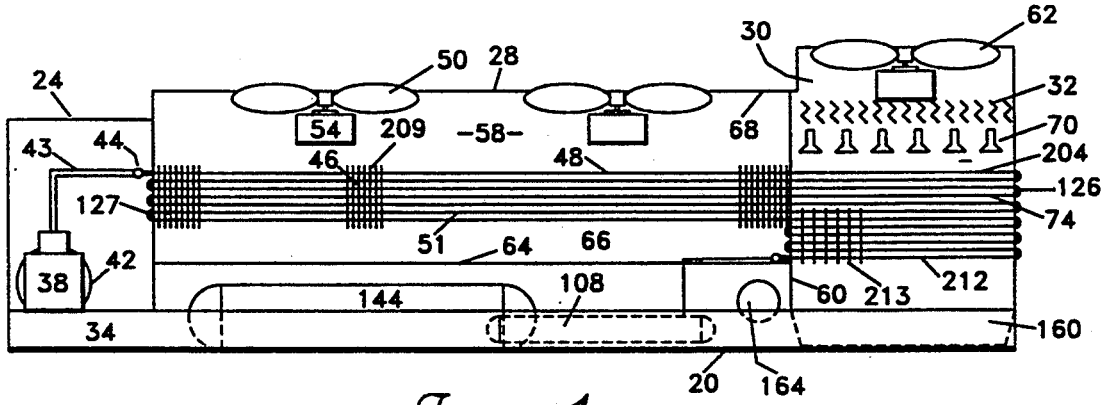
FIG. 1 is a side elevation of a preferred embodiment of the heat exchanger of the present invention showing the heat exchanger incorporated into a self contained liquid chiller package. The side panel has been removed to expose the interior elements.

Referring now to the drawings, wherein like references are used to indicate like elements, there is shown in FIG. 1 a side elevation of a mechanically refrigerated liquid chiller 20. The near side-panel has been removed to allow visual access to the interior elements. The far side-panel 66 having bottom edge 64 and top edge 68, remains in place. The chiller has a refrigeration circuit schematically shown in FIG. 2. The following description will require reference to both figures. A base 34 is provided having a channel cross-section. Compressor 38 is positioned on the base at one end. Drive motor 42 is shown in position to operate compressor 38. Liquid chilling evaporator 144 is provided with liquid refrigerant for its chilling function through float valve 132 which is connected to the evaporator 144 by upper and lower equalizing lines 136 and 140. The vapor resulting from evaporation of the liquid refrigerant is conveyed to the compressor 38 by suction line 148. The condenser, generally, 58, which is a preferred embodiment of the present invention includes a tubed heat transfer coil with fins and one or more fans, all described below. The condenser 58 delivers the liquid refrigerant condensed therein through its outlet liquid manifold 87 to liquid line 100. The liquid is transmitted to float valve 132 directly, via open receiver by-pass valve 121. The receiver 108 is connected to liquid line 100 in a "floating" arrangement via receiver connection conduit 120. The so-called floating receiver simply has the receiver connected to the liquid line via a dead-end branch conduit 120 so that there is no net liquid flow through the receiver. In this floating receiver arrangement, liquid sub-cooling provided by the condenser is preserved. In another option, no receiver 108 is provided and the evaporator 144 is employed as the receiver. In still another option, frequently employed when there are many evaporators, receiver by-pass valve 121 is closed and receiver inlet and outlet valves 104 and 116 respectively are opened. This places the receiver 108 in a flow-through arrangement which sometimes causes loss of the liquid sub-cooling provided by the condenser. Where a sub-cooling coil is employed with a flow-through receiver, it is normally connected to receive flow from the receiver outlet.

The Fluid Cooler of the Invention

The fluid cooler 58 of the present invention is illustrated in FIG. 1 applied as a refrigeration condenser in a unitary system combined with a refrigeration compressor 38 and evaporator 144, all mounted on a channel base 34. The fluid cooler/condenser 58 comprises a casing enclosing a heat exchanger having a dry or air-cooled section 28 with fans 50 and a wet or evaporatively cooled section 30 with fan 62. The wet and dry sections are positioned adjacent each other.

In the preferred embodiment, the heat exchanger includes an array of straight tubes 74 having a length equal to the combined length of the wet and dry sections 28 and 30 respectively and positioned to traverse both. The individual tubes 46, 51 in array 74 are arranged in planar layers, there being a top planar layer 180, positioned in the air stream leaving the heat exchanger and a bottom planar layer 182, positioned in the upwardly flowing air stream 188,190 entering the heat exchanger. Though a multi-row array having several tubing layers is shown, an alternate embodiment of the invention has all the tubes occupying a single planar layer. The face area of the heat exchanger in each section is typically the length of the tubes in that section multiplied by the width of the space occupied by the array. The tubes comprising the array are joined at the ends in either of two ways. One mode of connection is by U bends 126, 127, positioned at the end of a straight tubing length connecting each end of the straight length with the adjacent end of another straight tubing length. The second mode is by manifolds or headers 44, 87. As inlet, the manifold 44 serves as a fluid distributor by which a large inlet stream in transmitted to and divided between the tubes in a series of parallel tubing passes. As outlet the manifold 87 serves to aggregate outflow from the series of parallel tubing passes.

Figure 3:
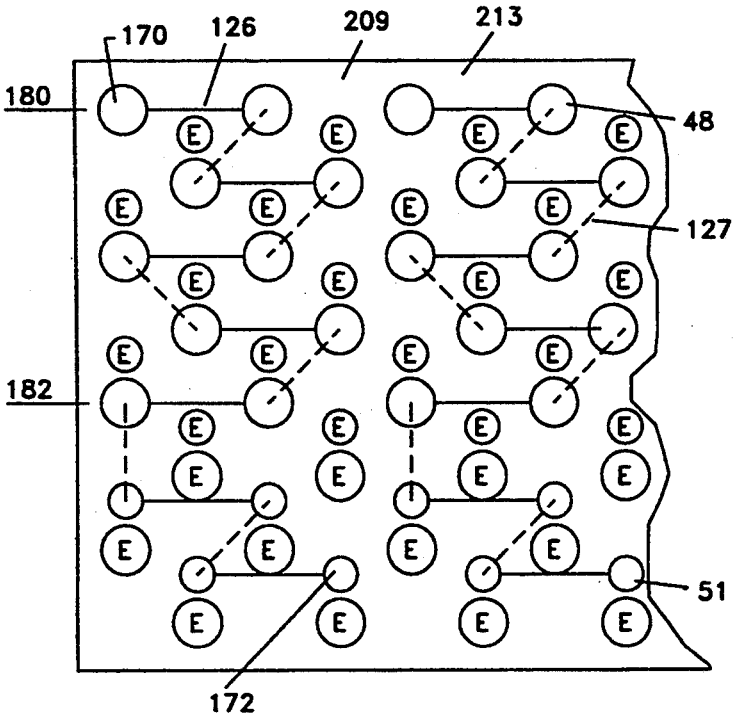
FIG. 3 is a detail of a fin employed in the heat exchanger, illustrating the presence of holes for tubes of two different diameters.

The lengths of tubing 46 traversing the dry or air-cooled section are provided with closely spaced fins 209. A plan view of a fin 209,213 used in the invention is shown in FIG. 3. Fin 209 is employed in the air-cooled section 28. Fin 213, shaped the same as fin 209 but of more corrosion resistant material, is employed in alternate embodiments of the present invention, in the wetted evaporative section 30. In the preferred embodiment, the lengths of tubing 46 which traverse the upper planar layers of the wet section have no fins. Tubes which no fins are called "bare" in the trade.

Materials of Construction

The materials of the tubing and the fins are dependent on the fluid or refrigerant intended to be cooled or condensed and on the coolant. In those cases where fluids like water, alcohol or chloro-fluorocarbons (CFC) are intended to be cooled or condensed by heat transfer to dry air only, the tubing will generally be of copper and fins aluminum. Where the intended fluids are ammonia and dry air, the tubing and fins will be galvanized steel or aluminum. However, where the tubing will be exposed to ammonia under both wet and dry conditions, galvanized steel tube and fin are preferred. Where the fluids to be cooled or condensed under wet conditions are CFC's or similar fluids, then copper tube and copper fin are preferred, though galvanized steel is sometimes used in these wet CFC applications.

Figure 2:
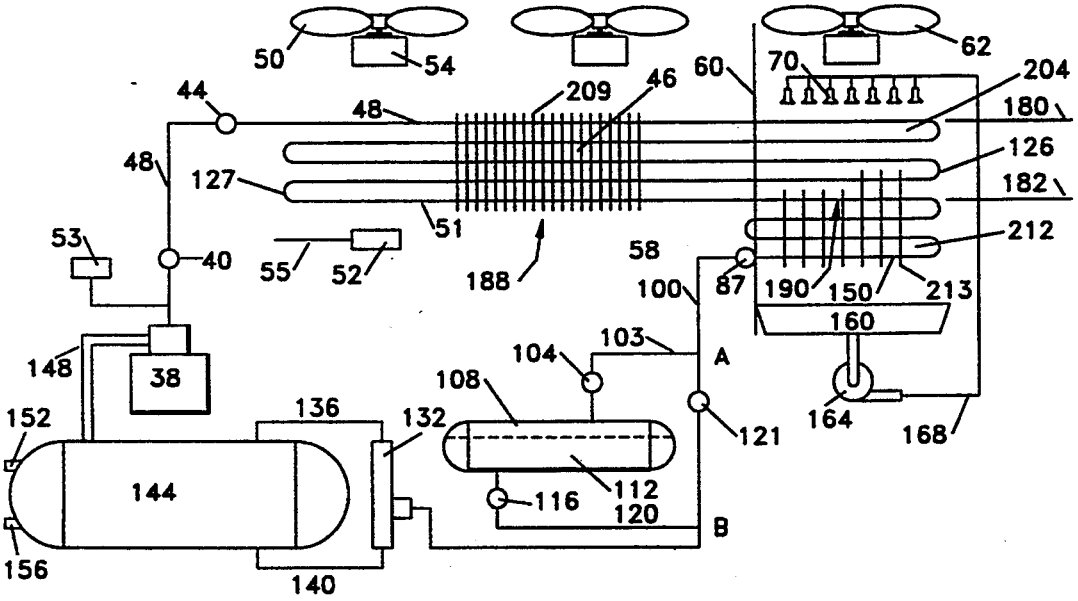
FIG. 2 is a piping schematic diagram of a refrigeration system showing how the preferred embodiment is piped into a refrigeration system.

In the heat exchange of the present invention as shown in FIGS. 1 and 2, where CFCs or similar fluids are to be cooled the tubing traversing both the wet and dry sections is copper. The fins, where used in the wet section are also copper. However, the fins on the copper tubes traversing the dry or air-cooled section are aluminum in one embodiment and copper in an alternative embodiment. By contrast, where the fluid to be cooled or condensed is ammonia, the tubes which traverse both the wet and the dry sections and the fins in the dry section and fins, where used, in the wet section are hot dip galvanized steel.

Plate 60, which is provided with holes having substantially the same size and geometric arrangement as fins 209, 213, forms a boundary between the dry section 28 and the wetted section 30. Plate 60 is fabricated of material, such as galvanized steel, which is structurally capable of supporting the weight of the heat transfer coil. Similar plates, not shown, are positioned at the ends of the coil for structural support.

An important feature of the present invention is that the lengths of tubing 46 for the dry air-cooled section 28, extend beyond plate 60 into the wet, evaporatively cooled section 30, thereby providing substantially improved economy in manufacture and improved compactness and piping simplicity.

Another important feature of the invention is that the superheated gas from the compressor discharge first enters the air-cooled section 28 and is desuperheated before it enters the evaporative section 30. The entry of cooler gas into the evaporative section reduces corrosion of and deposition of lime on the evaporative tubes, harmful conditions frequently encountered in evaporative condensers where the hot gases enter the evaporative section directly from the compressor.

Sub-Cooling Section

In order to provide improvement in system capacity, it is desirable to cool the fluid or condensed liquid refrigerant leaving the fluid cooler 58 to as low a temperature as possible. To best achieve this objective, the preferred embodiment of the invention includes a supplementary section of tubing 212 positioned under the extended bare tubing section 204 within the evaporatively cooled wet section 30 and subject to the coolest, driest air 190 entering the wet section. The tubing 150 within this section 212 has a smaller diameter than the tubing within the main coil whose tubes traverse both the dry and the wet section. The purpose of the smaller tubing is two-fold: First, to provide improved heat transfer between the flowing fluid and the tube wall by virtue of the higher Reynolds numbers and therefore higher film coefficients developed in smaller, compared with larger, tubes; Second, to provide the desired heat transfer within a smaller contained volume. A small contained refrigerant volume is an especially desirable feature where the refrigerants are costly or where the refrigerants, through some negative physical property such as flammability or toxicity, are limited by codes to a maximum quantity or weight per system or location.

Large and Small Tube in Heat Exchanger

In the preferred embodiment of the present invention, one or more tubes 51 laying in the lowest plane 182 (FIG. 3) of the tubing array 74 of the fluid cooler 58, have a smaller diameter than the tubes residing in the upper plane 180 (FIG. 3) of the tubing array 74. In the preferred embodiment of FIG. 1, this smaller diameter tubing is finned in both the dry section 28 and the wet section 30. The spacing between adjacent fins 209 within the dry section 28 is typically eight to sixteen per inch while the spacing between adjacent fins 213 in wet section 30 is typically three per inch. In other embodiments of the invention, the sub-cooling coil 212 employs bare tubes having no fins. In still another embodiment of the invention the tubes 150 of the subcooling coil 212 have the same diameter as the tubes in the main coil of the heat exchanger. In other embodiments of the invention, all the tubes in the wet section are finned; In still other embodiments, all the tubes in the wet section are bare.

The Fins

FIG. 3 shows a plan view of a part of a typical fin used in the dry section as 209 and in the wet section as 213. The fin 209, 213 has larger holes 170 for larger tubes 48 and smaller holes 172 for smaller tubes 51. The holes labeled with a "E" are empty when the fin is employed in the dry section 28.

Fan and Pump Controls

Figure 4:
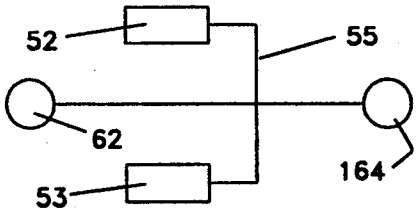
FIG. 4 shows a simple functional relationship between control sensors and the operation of the water pump and fans employed in the evaporative portion of the heat exchanger.

FIG. 4 displays the logical arrangement of control components which actuate, independently or together, the fan 62 and the pump 164 which provide cooling to the wet section 30. Thermostat 52 senses dry-bulb temperature of the air entering condenser 58. Pressure switch 53 senses the discharge pressure of compressor 38. In the preferred embodiment, the fan 62 and pump 164 are started when both the ambient temperature as detected by thermostat 52 and the discharge pressure as detected by pressure switch 53 are both above their preset values. In another embodiment of the invention, only the thermostat is employed to actuate both the fan 62 and pump 164. In still another embodiment, only the pressure switch is employed to actuate the fan and pump of the wet section. In alternate embodiments of the invention the controls 52, 53 are also employed to start, stop and control the speed of fans 50, providing air-flow through the dry section 28. Typical preset values for pressure are 140 psig for ammonia and 108 psig for CFC-12. Typical preset values for air temperature are in the range of 70°–90° F.

Under cold weather conditions, when over-cooling of the fluid might occur, or in refrigerating systems, where excessively low head-pressures can occur, the capacity of the heat exchanger is controlled, first by stopping the water and air flow over the wet section, then by successively slowing or stopping in sequence the fans 50 of dry section 30. However, because of closely spaced fins present on the tubing of the dry section, and its large total surface, even the operation of one fan may provide excess capacity. In that event, the present invention teaches that all the fans 50 of the dry section are stopped and only the fan 62 of the wet section, now operating dry, is operated. The limited surface comprised of unfinned tubes can, in very cold weather provide just the limited capacity required to stabilize system operation. One or more thermostats 52 are employed for this control arrangement.

The above described control arrangement emphasizes the unique inventiveness of the present invention which provides increased capacity under the hottest weather conditions and also provides the sharply reduced capacity required under cold weather conditions.

Alternate Tubing Orientation

Figure 5:
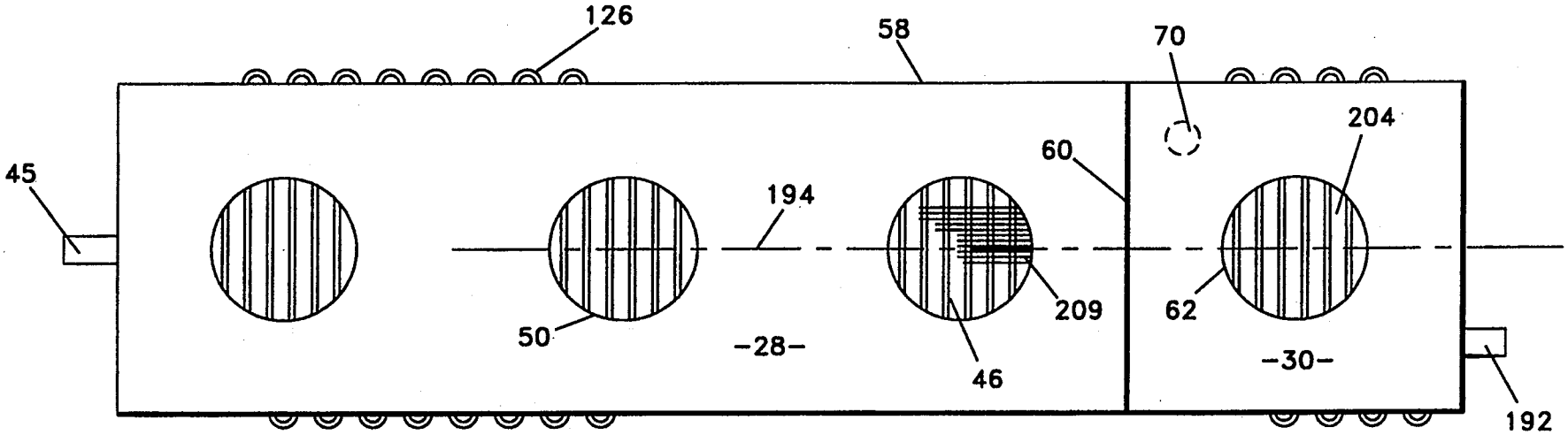
FIG. 5 shows an alternative construction of the heat exchange with the tubes in both the dry and wet sections running cross-wise.

FIG. 5 is a plan view of another embodiment of the present invention, where there is an imaginary line 194 joining the centers of the wet 30 and dry 28 sections, the tubes of the heat exchange element are perpendicular to the center-line 194 of the fluid cooler and the tubes traversing the wet section are flow extensions but not linear extensions of the tubes traversing the dry section. In this embodiment the tubes 204 in the upper plane 180 of the wet section 30 are bare and the tubes 46 in the dry section have closely spaced fins. In the embodiment of FIG. 5, the fin 213 of FIG. 3 is employed, thereby enabling the use of the larger tubes 48 in the upper tube plane 180 of the tubing array and smaller tubes 51 in the lower tubing plane 182 of the tubing array. Though only a single water spray nozzle 70 is shown, typically an array of nozzles 70 is provided to provide full wetting of the tubes/fins positioned within the wet section 30.

Liquid Cooler Application

In another embodiment of the invention, the heat exchanger 58 is employed in a closed liquid circuit to cool a glycol-water solution. The cooled solution is pump circulated from fluid cooler outlet 192 to one or more water cooled condensers located remotely and the warm solution aggregated from the outflow of the water cooled condensers is re-cooled by entry into the heat exchanger 58 via its fluid inlet 45. Such a fluid cooling arrangement provides the unique combination of low maintenance and low coolant sink temperature during hot weather combined with a unique ability to provide a last step of low capacity to ensure against overcooling the solution during periods of low load and cold outdoor conditions.

From the foregoing description, it can be seen that the present invention comprises an improved air-cooled fluid cooler incorporating an evaporative portion for both superior hot weather and cold weather performance. It will be appreciated by those skilled in the art that changes could be made to the embodiments described in the foregoing description without departing from the broad inventive concept thereof. It is understood, therefore, that this invention is not limited to the particular embodiment or embodiments disclosed, but is intended to cover all modifications which are within the scope and spirit of the invention as defined by the appended claims.

I claim:

1. A heat transfer device for transferring heat from a fluid to air, the device comprising a heat transfer element having a face area, the face area having a first portion having a center point and a second portion having a center point, the heat transfer element having a first array of spaced apart substantially straight parallel tubes distributed over the face area, each tube including a segment which traverses the first portion and another segment which traverses the second portion, and fins positioned on the tubes in heat transfer relation thereto over the first portion of the face area, means for moving air through the first portion and the second portion and means for distributing water over the second portion only.

2. A heat transfer device as recited in claim 1, further providing tube support means positioned between the first and second portions for supporting the straight tubes and further providing a second array of spaced apart substantially parallel tubes positioned beneath the second portion only.

3. A heat transfer device as recited in claim 2 where the tube segments traversing the first portion of the first array have fins positioned thereon, said first array fins having maximum average spacing of 0.125 inches and further providing that the tubes in the second array have fins positioned thereon, said second array fins having minimum average spacing of 0.33 inches.

4. A heat transfer device as recited in claim 2 further providing that the tube segments in the second array are unfinned.

5. A heat transfer device as recited in claim 1 further providing that the tubes in the first array are positioned in at least two parallel planes, an upper plane and a lower plane, and the tube segments in the upper plane which traverse the second portion are unfinned.

6. A heat transfer device as recited in claim 5 further providing that the tube segments in the lower plane which traverse the second portion are finned.

7. A heat transfer device as recited in claim 5 further providing that the tubes in the upper plane have a first diameter and the tubes in the lower plane have a second diameter and the second diameter is smaller than the first diameter.

8. A heat transfer device as recited in claim 1 further providing a first fan for moving air over the first portion, a second fan for moving air over the second portion and temperature sensing means subject to ambient temperature for sequentially turning off the fans on decreasing temperature, the second fan for moving air over the second portion being the last to remain running.

9. A heat transfer device as recited in claim 1 further providing a first fan for moving air over the first portion, a second fan for moving air over the second portion, the second fan having speed control means, and means subject to ambient temperature for controlling the speed of the second fan.

10. A heat transfer device as recited in claim 9 further providing that the means for distributing water over the second portion includes a pump having on and off conditions, and means subject to ambient temperature for starting and stopping the pump.

11. A heat transfer device for transferring heat from a fluid to air, the device comprising a heat transfer element having a face area, the face area having a first portion having a center point and a second portion having a center point, the heat transfer element having a first array of spaced apart substantially straight parallel tubes distributed over the face area, each tube including a segment which traverses the first portion and another segment which traverses the second portion, fins positioned on the tubes in heat transfer relation thereto, said fins being distributed over the first portion of the face area, first air moving means for moving air through the first portion only, second independent air moving means for moving air through the second portion only and means for distributing water over the second portion only.

12. A heat transfer device as recited in claim 11, further providing tube support means positioned between the first and second portions for supporting the straight tubes and further providing a second array of spaced apart substantially parallel tubes positioned beneath the second portion only.

13. A heat transfer device as recited in claim 12 where the tube segments traversing the first portion of the first array have fins positioned thereon, said first array fins having maximum average spacing of 0.125 inches and further providing that the tubes in the second array have fins positioned thereon, said second array fins having minimum average spacing of 0.33 inches.

14. A heat transfer device as recited in claim 12 further providing that the tube segments in the second array are unfinned.

15. A heat transfer device as recited in claim 11 further providing that the tubes in the first array are positioned in at least two parallel planes, an upper plane and a lower plane, and the tube segments in the upper plane which traverse the second portion are unfinned.

16. A heat transfer device as recited in claim 15 further providing that the tube segments in the lower plane which traverse the second portion are finned.

17. A heat transfer device as recited in claim 15 further providing that the tubes in the upper plane have a first diameter and the tubes in the lower plane have a second diameter and the second diameter is smaller than the first diameter.

18. A heat transfer device as recited in claim 11 further providing that first air moving means comprises a first fan for moving air over the first portion, second air moving means comprises a second fan for moving air over the second portion, and temperature sensing means subject to ambient temperature for sequentially turning off the fans on decreasing temperature; the second fan, for moving air over the second portion, being the last to remain running.

19. A heat transfer device for transferring heat from a fluid to air, the device comprising a heat transfer element having a face area, the face area having a first portion having a center point and a second portion having a center point, the heat transfer element having a first array of spaced apart substantially straight parallel tubes distributed over the face area, each tube including a segment which traverses the first portion and another segment which traverses the second portion, and fins positioned on the tubes in heat transfer relation thereto over the first portion of the face area, and further providing that the tubes in the first array are positioned in at least two parallel planes, an upper plane, the tubes therein having a first diameter and a lower plane, the tubes therein having a second diameter which is smaller than the first diameter and the tube segments in the upper plane which traverse the second portion are unfinned, means for moving air through the first portion and the second portion and means for distributing water over the second portion only.

20. A heat transfer device as recited in claim 19 further providing a first fan for moving air over the first portion, a second fan for moving air over the second portion and temperature sensing means subject to ambient temperature for sequentially turning off the fans on decreasing temperature, the second fan for moving air over the second portion being the last to remain running.

* * * * *